US006408773B2

(12) United States Patent
Resta

(10) Patent No.: US 6,408,773 B2
(45) Date of Patent: Jun. 25, 2002

(54) MACHINE FOR CUTTING CLOTH AND APPLYING BORDERS AND A PERIPHERAL BAND TO CLOTHS USED TO MANUFACTURE SPRING MATTRESSES

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 0 days.

(21) Appl. No.: 09/757,590

(22) Filed: Jan. 11, 2001

(30) Foreign Application Priority Data

Jan. 28, 2000 (IT) ..... BO00A0033

(51) Int. Cl.[7] ..... D05B 11/00; D05B 35/06; D05B 37/04

(52) U.S. Cl. ..... 112/2.1; 112/122

(58) Field of Search ..... 112/2.1, 117, 470.12, 112/122.7, 122

(56) References Cited

U.S. PATENT DOCUMENTS 2,076,178 A * 4/1937 Eames ..... 112/122.3
4,013,027 A * 3/1977 Cash ..... 112/2.1
4,125,079 A 11/1978 Black
5,040,473 A * 8/1991 Zesch et al. ..... 112/117
5,586,511 A * 12/1996 Porter et al. ..... 112/2.1
5,913,277 A * 6/1999 Resta ..... 112/470.12
6,012,403 A * 1/2000 Codos et al. ..... 112/117

FOREIGN PATENT DOCUMENTS

EP 0 220 368 5/1987
IT 1 183 122 10/1987

* cited by examiner

*Primary Examiner*—Ismael Izaguirre
(74) *Attorney, Agent, or Firm*—Guido Modiano; Albert Josif; Daniel O'Byrone

(57) ABSTRACT

A cloth cutting and border applying machine for manufacturing mattresses starting from a roll wound sheet, comprising a framework, a cloth moving device, two sewing machines arranged upstream of the moving device to form longitudinal stitch lines for stitching a strip supported on a roll support along lateral edges of the cloth, a cloth finishing assembly arranged downstream of the moving device and having a sewing machine with at least two needles for providing parallel transverse stitch lines and mounted on a carriage slideable on guides to join a band to the cloth along transverse stitch lines, a cutter for cutting between the parallel stitch lines to separate a cloth portion lying downstream of the assembly from one lying upstream, a carriage actuator, and a band cutter to cut the band and the cloth transversely between the two stitch lines.

9 Claims, 7 Drawing Sheets

MACHINE FOR CUTTING CLOTH AND APPLYING BORDERS AND A PERIPHERAL BAND TO CLOTHS USED TO MANUFACTURE SPRING MATTRESSES

BACKGROUND OF THE INVENTION

The present invention relates to a machine for cutting cloth and for applying borders and a peripheral band to cloths used to manufacture spring mattresses.

It is known (see in particular FIGS. 1, 2 and 3) that a spring mattress is constituted by a rectangular prism-like metallic body 1 which is composed of a plurality of biconical springs 2 which are connected one another and are covered by one or more layers 2*a* of insulating material such as felt, foamed rubber and the like.

The upper and lower faces of the body 1 are covered by two rectangular cloths or quilts 3 and 4 whose edges are joined by a band 5 which peripherally closes the mattress.

Each cloth or quilt 3 and 4 is constituted, for example, by a panel 6 of soft material which is covered above and below by sheets of fabric 7, 7*a* or the like, the panel and the sheets being joined by a more or less ornamental quilting. A band 10 is fixed to the inner edges of the quilts 3 and 4 by means of two parallel stitch lines 8 and 9, so as to form a flap 11 which protrudes from the stitch lines 9 and is thus spaced from the stitch line 8.

When the quilts 3 and 4 are applied to the opposite faces of the body 1, the flaps 11 are first folded outwards and then under the first turn 12 of the springs 2 and finally fixed thereto with metal staples 13.

In this manner, the quilts 3 and 4 are fixed to the body 1, while their borders between the stitch lines 8 and 9 remain free so that they can be connected to the peripheral band 5 by an operation for final application of a border for closure, as shown in FIG. 3.

Currently, the band 10 is fixed to the quilts 3 and 4 manually, at high cost, also because it requires additional operations for positioning and trimming the cloths or quilts.

SUMMARY OF THE INVENTION

The aim of the present invention is to provide a machine which allows to apply a peripheral band while the cloths are being cut and a border is being applied thereto.

Within this aim, an object of the present invention is to provide a machine which can be combined with an apparatus for forming a quilt constituted by one or more sheets unwound continuously from rolls.

This and other objects are achieved with a machine whose characteristics are defined in the appended claims.

BRIEF DESCRIPTION OF THE DRAWINGS

Further features and advantages of the present invention will become better apparent from the following description of a preferred embodiment, illustrated only by way of non-limitative example in the accompanying drawings, wherein the invention has been applied to an apparatus disclosed in U.S. Pat. No. 5,913,277 by the same Applicant, which is highly effective in the manufacture of quilts for covering spring mattresses. In the drawings.

DESCRIPTION OF THE PREFERRED EMBODIMENTS

Figure 4:
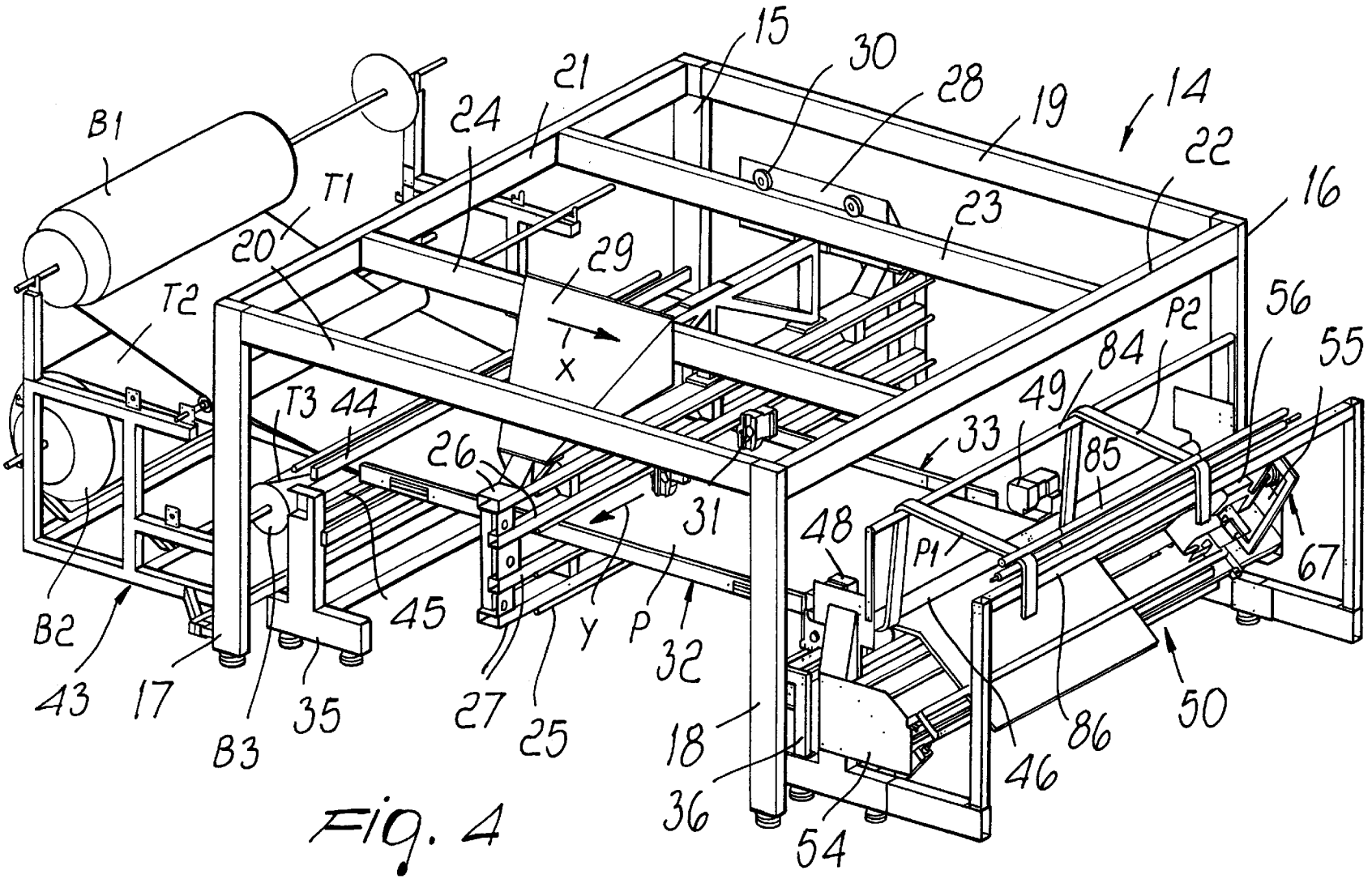
FIG. 4 is a perspective view of the known apparatus and of the machine according to the invention associated therewith.
Figure 5:
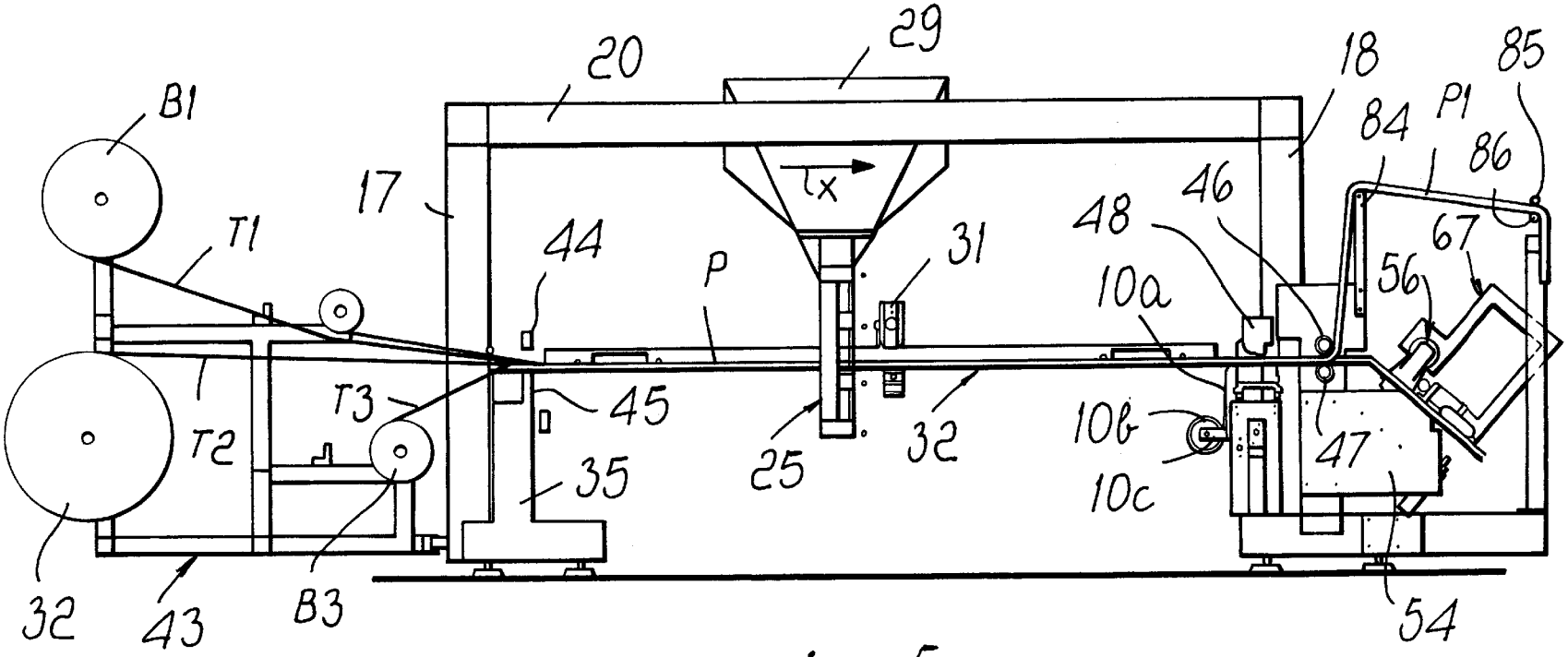
FIG. 5 is a side elevation view of the machine and of the apparatus of FIG. 4.

With reference to FIGS. 4 and 5, an apparatus according to U.S. Pat. No. 5,913,277 is disclosed comprising a framework, generally designated by the reference numeral 14, which is composed of four vertical columns 15, 16, 17 and 18 arranged at the corners of a rectangle. The columns 15, 16 and 17,18 are connected, at the top, by a pair of longitudinal beams 19, 20, while two additional transverse beams 21 and 22 connect one another the tops of the columns 15, 16 and 17, 18.

Two longitudinal members 23 and 24 lie between the transverse beams 21 and 22, are parallel to each other and to the beams 19 and 20 and constitute the track for the sliding of a carriage 25 that supports one or more sewing machines.

The carriage 25 is composed of a double pair of horizontal and parallel beams 26 and 27 which lie above and below the plane of arrangement of the cloth P to be quilted and have opposite ends which are rigidly connected to each other. The carriage 25 is suspended from a pair of shoulders 28 and 29 which rest on the track 23, 24 by means of rollers 30.

The carriage 25, is movable along the track 23 and 24 in the direction X, actuated by means of an appropriate and conventional motor drive not shown in the drawings.

The heads for moving the needle of two sewing machines 31 are mounted on the pair of upper beams 26 and the corresponding hook assembly is mounted on the pair of lower beams 27. It is also possible to provide a different number of sewing machines. In a known manner, by means of an additional motor drive, the sewing machines 31 are actuated in the direction Y, which is perpendicular to the direction X, so that by actuating the carriage 25 and the sewing machines 31 it is possible to trace the intended paths on the quilt.

Figure 6:
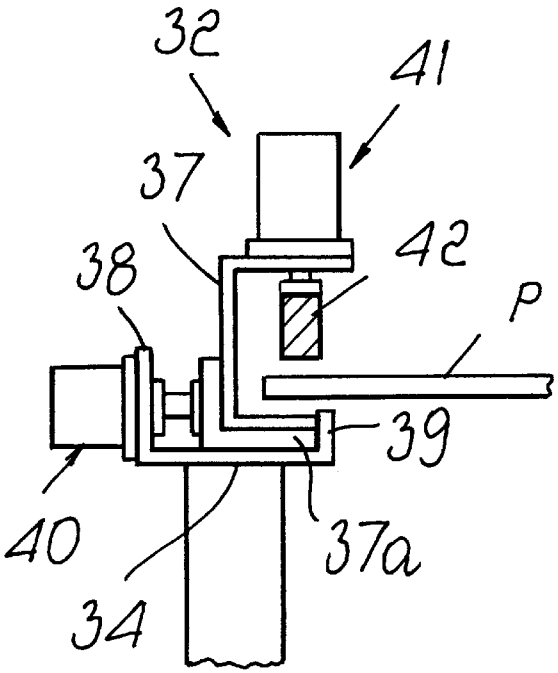
FIG. 6 is a sectional view of the lateral guides of the quilt.

Two guides 32 and 33 lie between the pair of upper beams 26 and the pair of lower beams 27 of the carriage 25 and are adapted to guide the lateral edges of the cloth P to be quilted. As shown in FIG. 6, each guide is composed of a U-shaped beam 34 which is longitudinal (i.e., lies in the direction X) and whose opposite ends are fixed on supports 35, 36 located at the columns 15, 17 and 16, 18, respectively. The beams 34 define supporting surfaces on which profiles 37 provided with a C-shaped cross-section and open onto each other are arranged. The C-shaped cross-section of the guide 32 lies opposite the C-shaped cross-section of the guide 33.

Each profile 37 is movable between the outer vertical wing 38 and the inner vertical wing 39 of the beam 34 by means of pneumatic jacks 40 whose cylinders are flanged to the outer wing 38 of the beam 34 and whose stem is rigidly coupled to the profile 37.

The jacks 40 that relate to the guide 32 are actuated in opposition to the jacks of the guide 33, so that the profiles 37 of the guides are simultaneously moved towards and away from each other with respect to the longitudinal central plane of the apparatus.

The reference numeral 41 designates additional pneumatic jacks whose cylinders are mounted vertically above the profiles 37. A bar 42 is coupled to the stems of the jacks 41 and extends inside the profile 37. The bar 42 constitutes the movable jaw of a clamp which is designed to engage the longitudinal edge of the cloth to be quilted and to clamp it against the fixed jaw, which is constituted by the lower wing 37*a* of the profile 37 that rests on the beam 34.

In the illustrated example, the cloth P to be quilted is produced by superimposing a set of three sheets T1, T2, T3 which, in a manner which is known and therefore not described in detail, are taken from respective rolls B1, B2, B3 supported by a framework 43. The number of sheets and their thickness can of course be any according to requirements.

The sheets T1, T2, T3 unrolled from the rolls B1, B2, B3 are joined between a pair of superimposed bars 44 and 45 which lie transversely to the direction X on the support 35 and are inserted in the guides 32 and 33 between the bars 42 and the wings 37*a* of the profiles 37.

The upper bar 44 is movable vertically with respect to the lower bar 45 by means of pneumatic jacks (not shown), so as to provide a transverse clamp which is adapted to transversely lock the cloth P to be quilted upstream of the guides 32, 33.

It is evident that the longitudinal clamps 37*a,* 42 and the transverse clamp 44, 45 delimit on three sides the quilting region, which is delimited on the fourth side by a pair of traction rollers 46, 47 located at the output of the guides 32 and 33. The rollers 46, 47, by means of respective motors, are actuated so as to rotate in opposite directions, so as to pull in the direction X the cloth P inserted between them.

Between the outlet of the guides 32, 33 and the traction rollers 46, 47 there are two laterally arranged stitching and cutting devices 48 and 49, each of which comprises a sewing machine and a cutter in order to join, with stitch lines at the lateral edges of the quilted cloth, two respective longitudinal strips 10*a* and in order to cut the borders of the cloth or quilt that lie outside the stitch lines.

Figure 1:
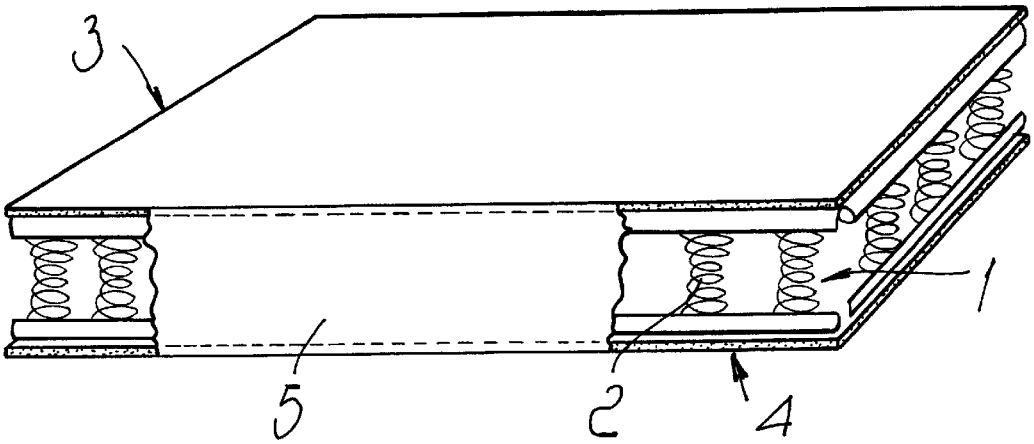
Fig. 1 PRIOR ART
FIGS. 1–3 show the constructional structure of a prior art mattress.
Figure 2:
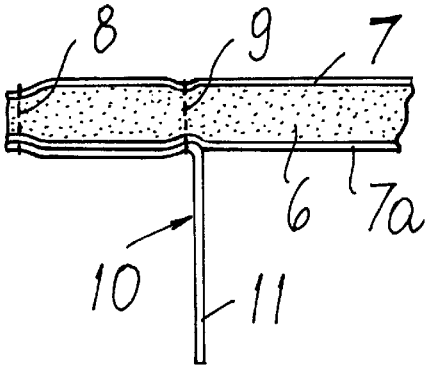
Fig. 2 PRIOR ART
Figure 3:
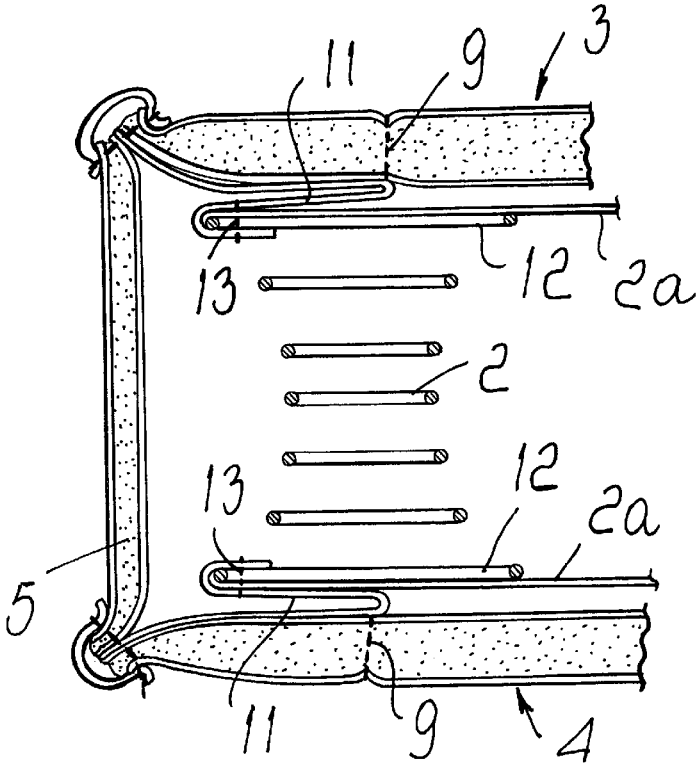
Fig. 3 PRIOR ART

The longitudinal strips 10*a* are made of fabric or the like and are taken from respective rollers 10*b* rotatably supported on brackets 10*c* (see FIG. 5) which are fixed to the support 36 below the devices 48 and 49. The sewing machines of the devices 48, 49 have a double needle, so as to allow to fix the longitudinal strips 10*a* to the cloth or quilt P with two stitch lines, as shown by 8 and 9 in FIG. 2, and provide flaps 11 which lie inside the lateral edges of the quilt. The cutters of the devices 48 and 49 are arranged downstream of the needles of the respective sewing machines, and each one is constituted for example by a rotating blade (not shown in the drawings but known in the art), which cuts the lateral edges of the quilt outside the longitudinal stitch lines 8 and 9, forming two strips of waste P1, P2.

The stitching and cutting devices 48 and 49 are an integral part of the machine, which according to the invention performs the transverse cutting of the cloth or quilt P, stitches the edges upstream and downstream of the provided cut, and applies two additional strips 10*d* (which lie transversely to the strips 10*a*), with which the edges upstream and downstream of the cut are provided.

Figure 9:
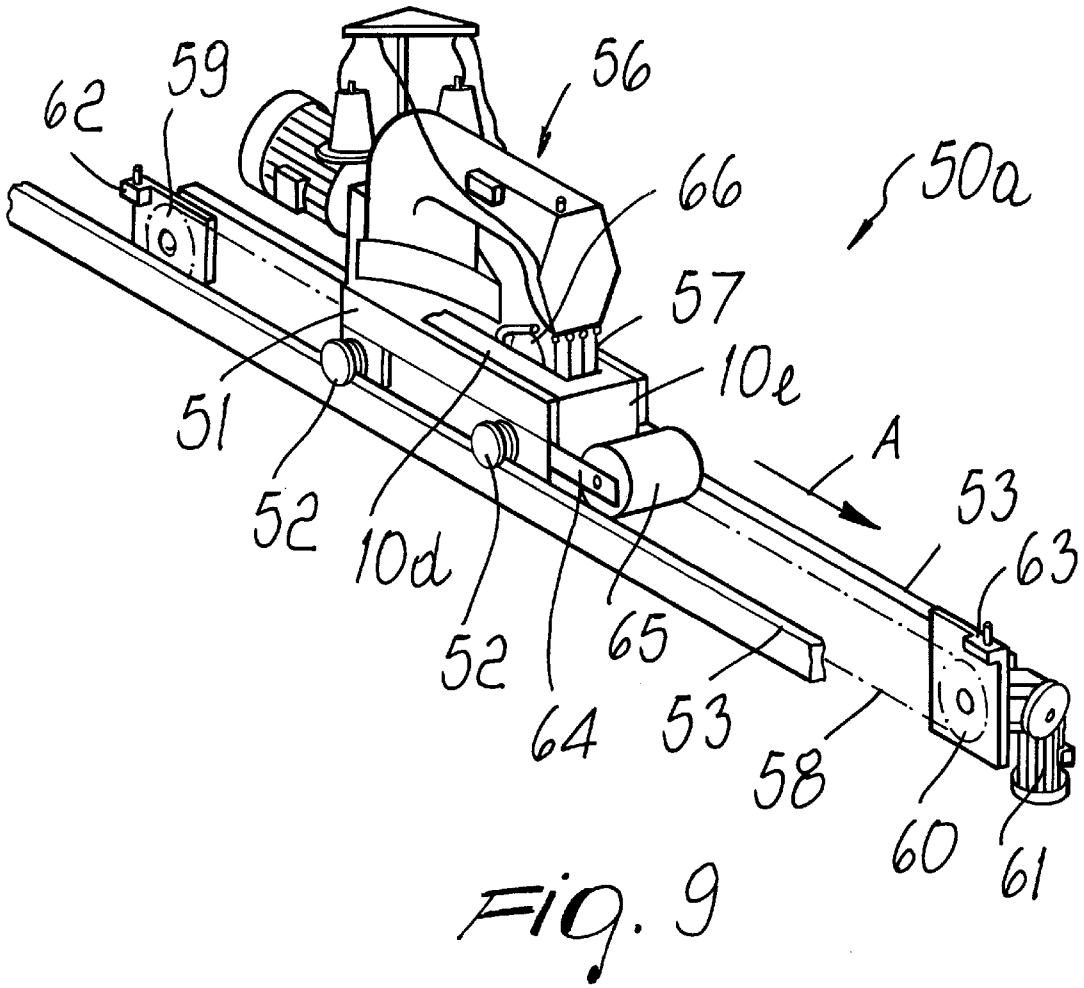
FIG. 9 is a perspective view of the means for transversely cutting and stitching the quilt.
Figure 7:
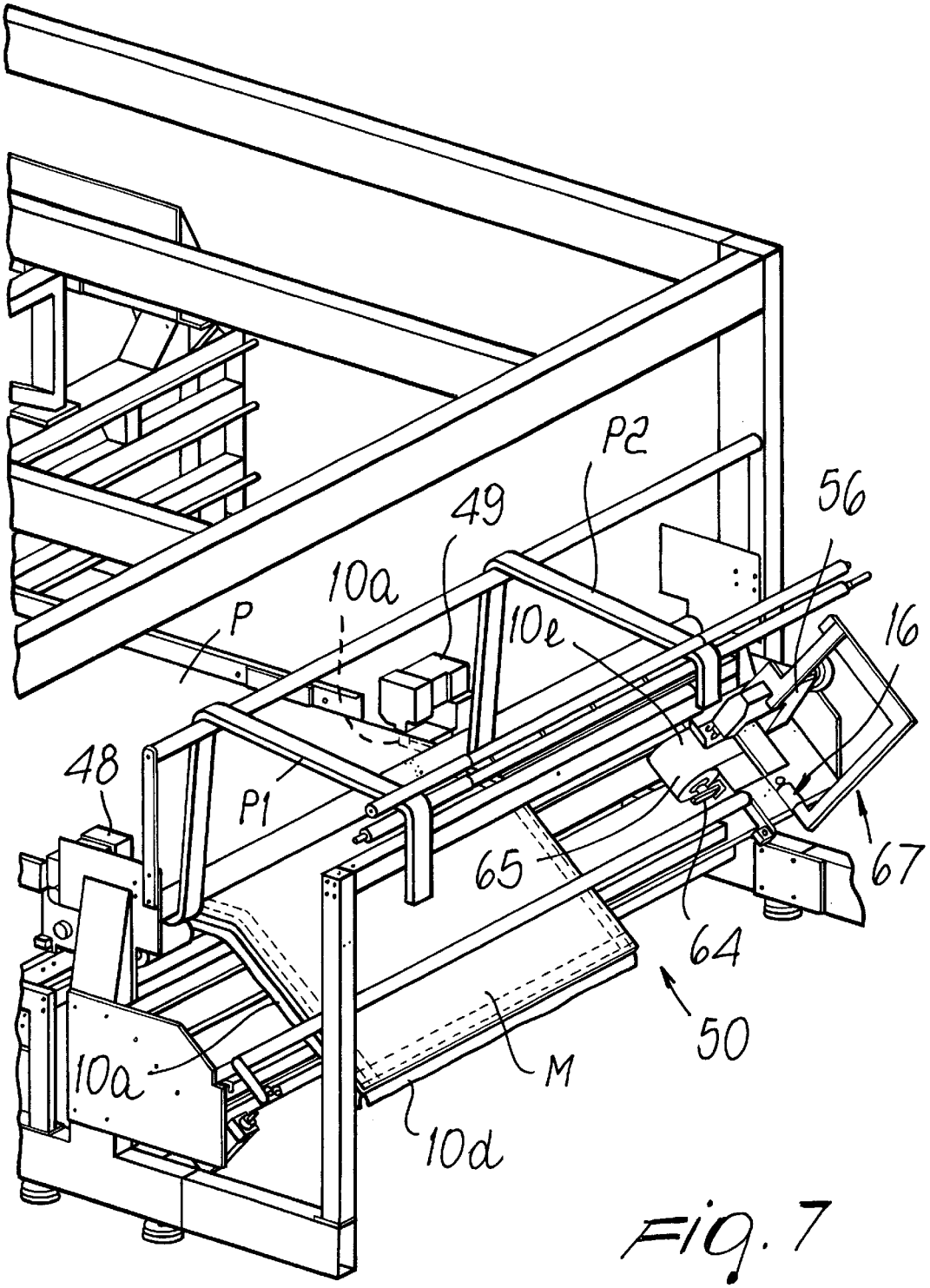
FIG. 7 is a perspective view of the region of the apparatus where the machine for transversely stitching and cutting the quilt before cutting is arranged.
Figure 8:
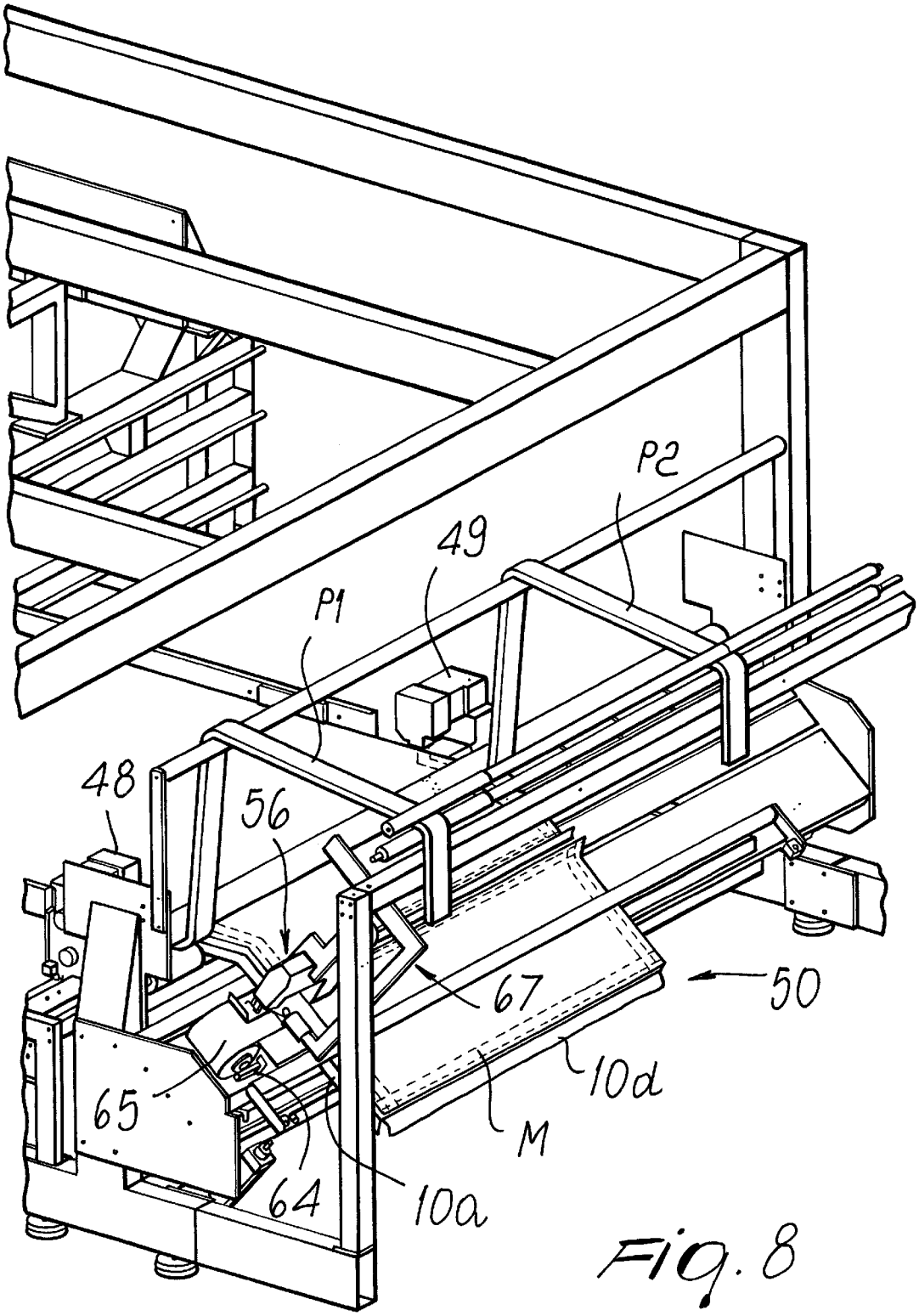
FIG. 8 is a view of the same region of FIG. 7 after cutting has been completed.

As shown in FIGS. 7, 8 and 9, the machine is generally designated by the reference numeral 50 and comprises a finishing unit 50*a* composed of a box-like carriage 51 which, by means of four free wheels 52, slides on a pair of parallel rails 53 whose opposite ends are fixed to side walls 54, 55 (FIG. 4) of the framework of the machine 50. A sewing machine 56 of the type with four needles 57 is fitted on the carriage 51 and can therefore produce four parallel stitch lines.

The sewing machine 56 is moved in the direction Y, which lies transversely to the direction X, by means of a movement system which comprises a chain 58 having a portion which is fixed to the carriage 51 and being closed in a loop on a pair of sprockets 59, 60 which are fitted in a cantilever fashion on the sides 54, 55. The sprocket 59 is free, while the other sprocket 60 receives its motion from a gearmotor 61 which is flanged to the side 54. The gearmotor 61 is controlled by a pair of stroke limit switches 62 and 63 which determine the points of inversion of the back-and-forth strokes. Two arms 64 cantilever out in front of the carriage 51 (FIG. 9) in order to rotatably support a roll 65 of a band 10*e* which, cut longitudinally in half, provides the two strips 10*d* which, at the output of the machine 50, will be associated with the front and rear transverse edges of the finished quilt. The four transverse stitch lines are formed only during the outgoing stroke of the sewing machine 56 while the quilt is cut in the region between one pair of sewing lines and the adjacent one.

In order to produce the separation cut, there is a rotating circular blade 66 which is rotatably supported in the carriage 51.

The rotating blade 66 is actuated by an electric motor being accommodated in the carriage 51 or, by means of an appropriate transmission, by the same motor that drives the sewing machine 56.

The rotating blade 66 protrudes, with an upper sector, from the upper face of the carriage 51 through a slot formed in the latter.

A unit, generally designated by the reference numeral 67 in FIGS. 4, 5, 7, 8 and 9, is further fixed on the sewing machine 56; said unit, as will become apparent hereinafter, is designed to cut the transverse band 10*e* after it has been joined to the quilt P.

Figure 10:
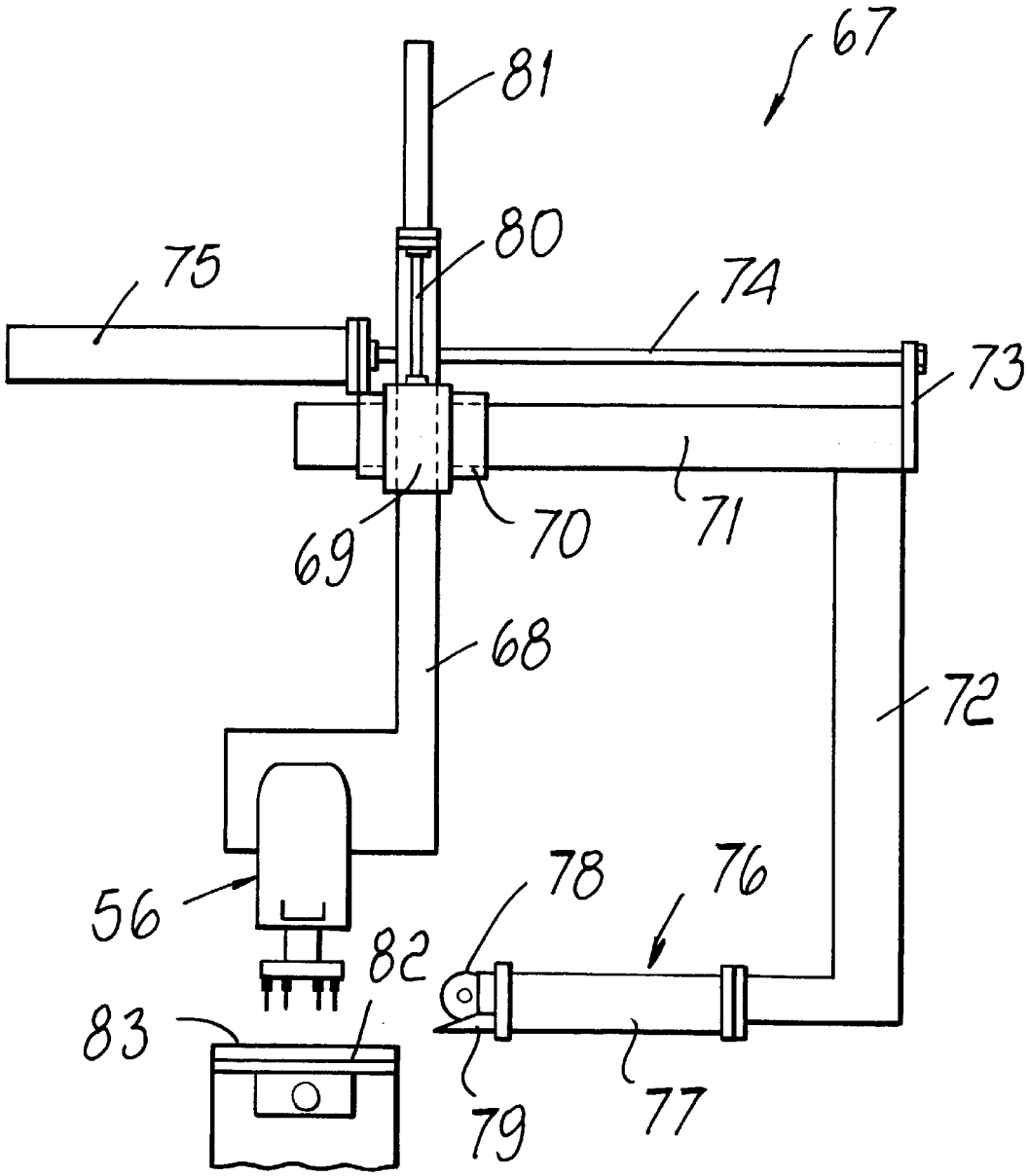
FIG. 10 is a schematic view of a unit for cutting the transverse band.

As shown more clearly in FIG. 10, the unit 67 comprises a frame which is composed of a post 68 which is rigidly coupled to the body of the sewing machine 56 and on which a sleeve 69 is slideable.

Another sleeve 70 is rigidly coupled to the sleeve 69, is perpendicular thereto, and a first arm 71 is guided therein. A second arm 72 and an L-shaped element 73 for coupling the stem 74 of a jack, whose cylinder 75 is fixed to the sleeve 70, are rigidly coupled to the end of the arm 71.

The axis of the jack 74, 75 is parallel to the axis of the sleeve 70, so that by activating the jack it is possible to move the second arm 72 towards or away from the sewing machine 56.

The second arm 72 is substantially normal to the first arm 71, and a cutter 76 is supported at its lower end; said cutter is composed of an electric motor 77 which drives a rotating blade 78 below which there is a feeler 79 which is designed to collect the two strips 10*d* that slide on the sliding surface 83 of the sewing machine 56 and to raise them against the blade 78 in order to produce cutting and thus separate them from the remaining band 10*e,* which has not yet been cut in half by the blade 66.

The stem 80 of a jack is further rigidly coupled to the sleeve 69 and its cylinder 81 is fixed to the top of the post 68. Accordingly, by actuating both jacks 74, 75 and 80, 81, the cutter 76 can perform perpendicular movements which allow to position it with respect to the sewing machine 56. In particular, by moving the cutter 76 towards the sewing machine 56 the feeler 79 can engage in a slot 82 of the quilt sliding surface 83 which is located behind the blade 66, so as to facilitate the insertion of the strips 10*d* between the feeler and the blade 78.

The operation of the described machine 50 and apparatus 14 is as follows.

Assume that the apparatus 14 is in an operating condition such as the one shown in FIGS. 4 and 5, in which the cloth or quilt P is locked upstream between the bar 44 and the beam 45 and downstream between the rollers 46 and 47, while the lateral edges of the cloth are locked in the guides 32, 33 by the bars 42. In practice, the lateral guides 32, 33, the bar 44 and the beam 45 and the rollers 46, 47 form a frame which keeps the cloth or quilt P stretched both transversely and longitudinally.

Assume also that the sewing machine 56 is in the lateral position shown in FIG. 7, with the cutter 76 in the inactive position, spaced from the sewing machine 56.

With the cloth P in this condition, quilting is performed by moving the carriage 25 in the direction X and the sewing machines 31 in the direction Y.

As quilting proceeds, the machine 50 produces the four transverse stitch lines and transversely cuts the quilt downstream of the rollers 46 and 47.

Due to the transverse stitching of the cloth or quilt P, the band 10*e* is applied under said quilt and, by simultaneously performing the cutting operation by means of the blade 66, is divided into two transverse strips 10*d* upstream and downstream of the cut. When the carriage 51 has crossed the quilt, thus moving from the position of FIG. 7 to the position of FIG. 8, the two stitch lines upstream of the cut close the front edge of the quilt P which is locked peripherally between the lateral bars 42 and the wings 37*a,* the bar 44 and the beam 45 and the rollers 46 and 47, while the two stitch lines located downstream of the cut close the rear edge of the previously quilted quilt, which is now designated by the reference letter M in FIG. 8.

At this point, by actuating the jacks 74, 75 and 80, 81, the cutter 76 is made to approach so that the feeler 79 enters the slot 83 below the strips 10*d* that the blade 66 has already formed by cutting the band 10*e* in half. By causing the advancement of the cutter 76 under the body of the sewing machine 56, the strips 10*d* are cut. Then the jacks 74, 75 and 80, 81 are actuated so as to disengage the feeler 79 from the slot 82 and move the cutter 76 into the inactive position.

Once the quilting of the stretched cloth P has been completed, the two longitudinal bars 42 and the transverse bar 44 are raised and, by releasing the lateral edges and the upstream edge of the quilt, allow the rollers 46, 47 to unroll from the rolls B1, B1, B3 new portions of sheets T1, T2 and T3 and form a new quilt P.

It should be noted that during unrolling, the two devices 48 and 49 sew the lateral edges of the quilt that leaves the guides 32, 33 and cut the strips of waste P1, P2. In order to remove the strips of waste P1, P2 (see FIGS. 4 and 5) a transfer roller 84 and two smaller rollers 85 and 86 are provided being actuated so as to rotate in opposite directions; the waste is guided between said smaller rollers. The actuation of the smaller rollers 85 and 86 can be derived from the actuation of the traction rollers 46, 47.

Once the rear edge of the quilted cloth, which was located below the bar 44, has arrived at the stitch line of the sewing machine 56, the rollers 46, 47 are stopped and the jacks 41 that lower the bars 42 and the jacks that lower the bars 44 are actuated sequentially, locking the lateral and rear edges. Then, by actuating the jacks 40, the lateral edges of the quilt P are spaced so as to subject the quilt to transverse traction, while longitudinal traction is determined by continuing the rotation of the rollers 46, 47 after the bar 44 has transversely locked the cloth P against the beam 45.

At this point, quilting is performed and the steps of the process are repeated in the manner described above.

It is evident that the described invention fully achieves the intended aim and objects. In particular, it is noted that the machine allows to automate the application of the transverse strips 10*d* and longitudinal strips 10*a,* thus providing a considerable cost saving.

The disclosures in Italian Patent Application No. BO2000A000033 from which this application claims priority are incorporated herein by reference.

What is claimed is:

1. A machine for cutting cloths and applying borders thereto, for the manufacture of mattresses starting from at least one component sheet which is wound in a roll, including: a framework, movement means for moving said cloth in an advancement direction and along a horizontal plane of arrangement; two sewing machines for forming longitudinal stitch lines along the lateral edges of said cloth, said sewing machines being arranged upstream of said movement means, and being each provided with a support for a roll of strip made of fabric which is guided and stitched along a respective longitudinal edge of said cloth; guides which lie transversely to the advancement direction of the cloth; and a finishing assembly arranged downstream of said movement means and comprising: a carriage which is slideable on said guides; a finishing sewing machine of a type having at least two needles and supported on said carriage; a support; a roll supported at said support for a fabric band which is guided so as to adhere transversely to said cloth, said finishing sewing machine being operatable to join said band to said cloth along at least two transverse stitch lines; actuating means for actuating said carriage on said guides between two stroke limit positions which lie laterally to said cloth, and cutting means for cutting said band and said quilt between said two stitch lines and for forming two transverse strips.

2. The machine of claim 1, further comprising further cutting means for cutting said transverse strips after application thereof to the cloth.

3. The machine of claim 2, wherein said sewing machines for producing longitudinal stitch lines are of two needles type, whereby to join each one of said lateral strips to said cloth along two parallel stitch lines.

4. The machine of claim 2, wherein said finishing sewing machine fitted on said carriage is of a four needles type, whereby to provide two pairs of parallel stitch lines, said cutting means comprising a blade which is arranged so as to cut said cloth and said band between a first one of said pairs of said transverse stitch lines and a second one of said pairs.

5. The machine of claim 4, wherein said further cutting means for cutting said transverse strips after their application to the cloth comprise: a cutter, which is movably supported on said carriage; and cutter actuation means for actuating said cutter between an inactive position and a position for cutting said transverse strips.

6. The machine of claim 5, comprising a frame which is rigidly coupled to said carriage, and supports said cutter, said frame being composed of two arms which are movable at right angles to each other and are actuated so as to move said cutter between said inactive position and said cutting position.

7. The machine of claim 6, wherein said cutter comprises a rotating blade; a collection feeler located under said rotating blade, and which is adapted to engage a slot of a sliding surface of said finishing sewing machine mounted on said carriage in order to penetrate under said transverse strips and lift the strip against said blade.

8. The machine of claim 3, wherein said sewing machines adapted to stitch the lateral edges of said cloth comprise flap cutting means for cutting lateral flaps of the cloth that lie outside the stitch lines.

9. The machine of claim 1, in combination with an apparatus for forming the cloth which comprises: a framework; a pair of guides for supporting lateral edges of said cloth which are supported by said framework and lie along said advancement direction on a horizontal plane of arrangement; clamp means which are arranged along said guides and are actuated so as to lock said cloth transversely; a carriage which is slideable on said frame in said advancement direction; at least one sewing machine which is slideable on said carriage in a direction which is transverse to said advancement direction, and actuating means for actuating said carriage and said sewing machine to perform quilting of said cloth.

* * * * *